US005147745A

United States Patent [19]

Russel

[11] Patent Number: 5,147,745

[45] Date of Patent: Sep. 15, 1992

[54] APPARATUS FOR PRODUCING RAISED MULTIPLE COLOR IMAGES

[75] Inventor: Matthew J. Russel, Mendon, N.Y.

[73] Assignee: Eastman Kodak Company, Rochester, N.Y.

[21] Appl. No.: 604,272

[22] Filed: Oct. 29, 1990

[51] Int. Cl.[5] ..... G03G 13/26

[52] U.S. Cl. ..... 430/49; 430/126; 430/45

[58] Field of Search ..... 430/49, 42, 44, 47, 430/126

[56] References Cited

U.S. PATENT DOCUMENTS 3,808,026 4/1974 Sato et al. ..... 117/37 LE
4,269,920 5/1981 Wada et al. ..... 430/107
4,639,405 1/1987 Franke ..... 430/124
4,868,611 9/1989 Germain ..... 430/42
5,030,531 7/1991 Goodman ..... 430/42

*Primary Examiner*—John Goodrow
*Attorney, Agent, or Firm*—Tallam I. Nguti

[57] ABSTRACT

Electrostatographic reproduction method and apparatus for producing a raised multiple color image of an original. The apparatus has a plurality of toner image producing electrostatographic sub-assemblies including, a first, an intermediate, and final assembly. The first and intermediate assemblies include devices for producing color separation toner images, and the final assembly produces a full colorless toner image of the original.

4 Claims, 1 Drawing Sheet

10
12
14
16
18
20
30
32
34
40
42
44
46
50
52
54
56
58
60
62
64
DR1
DR2
DR3
TR1
TR2
L1
L2
L3
L4
L5
F1
F2
F3
E1
E2
C
M
Y
Z

APPARATUS FOR PRODUCING RAISED MULTIPLE COLOR IMAGES

BACKGROUND OF THE INVENTION

1. Field of the Invention

This invention relates to electrostatography, and more particularly to an electrostatographic copier or printer for producing raised multiple color images.

2. Description Relative to the Prior Art

Apparatus for producing raised images on a suitable substrate such as a copy sheet, for example, those apparatus employing lithographic methods, do so by applying a colorless powder to wet ink on an ink printed substrate. For quality results, the powder must be applied before such ink dries. This method works satisfactorily for the production of raised single color images on such substrate, but does not work well for the production of raised multiple color images. This is because the production of two color images, for example, involves the use of a two-color press which first prints with a first wet ink of a first color, and then with a second wet ink of a second color before the colorless powder can be applied. Ordinarily, by the time of printing with the second wet ink, the first ink has already dried, thereby defeating any efforts to apply and have the colorless powder adhere to the dried first ink. There is therefore a need for methods and apparatus for efficiently producing such raised multiple color images.

SUMMARY OF THE INVENTION

It is an object of the present invention to provide an electrostatographic method and apparatus for producing raised multiple color images.

A further object of the present invention is to provide an electrostatographic method and apparatus for producing a raised multiple color image on a substrate which has high quality and uniform glossing in image and non-image areas of the substrate.

In accordance with the present invention, a method is provided for forming a raised multiple color image on a substrate. The method comprises the steps of (i) forming a first latent image electrostatically on an image-bearing member, (ii) forming a second latent image electrostatically on an image-bearing member, (iii) toning the first and second latent images with toner particles of a first color and a second color, respectively, (iv) forming a third latent image electrostatically on an image-bearing member such that the third image is a combination of the first and second images, (v) toning the third latent image with colorless toner particles, and (vi) transferring the first, second, and third toned images in registration to the substrate.

BRIEF DESCRIPTION OF THE DRAWINGS

In the detailed description of the invention presented below, reference is made to the accompanying drawings, in which.

DESCRIPTION OF THE PREFERRED EMBODIMENT

Figures 1, 2A, 2B:
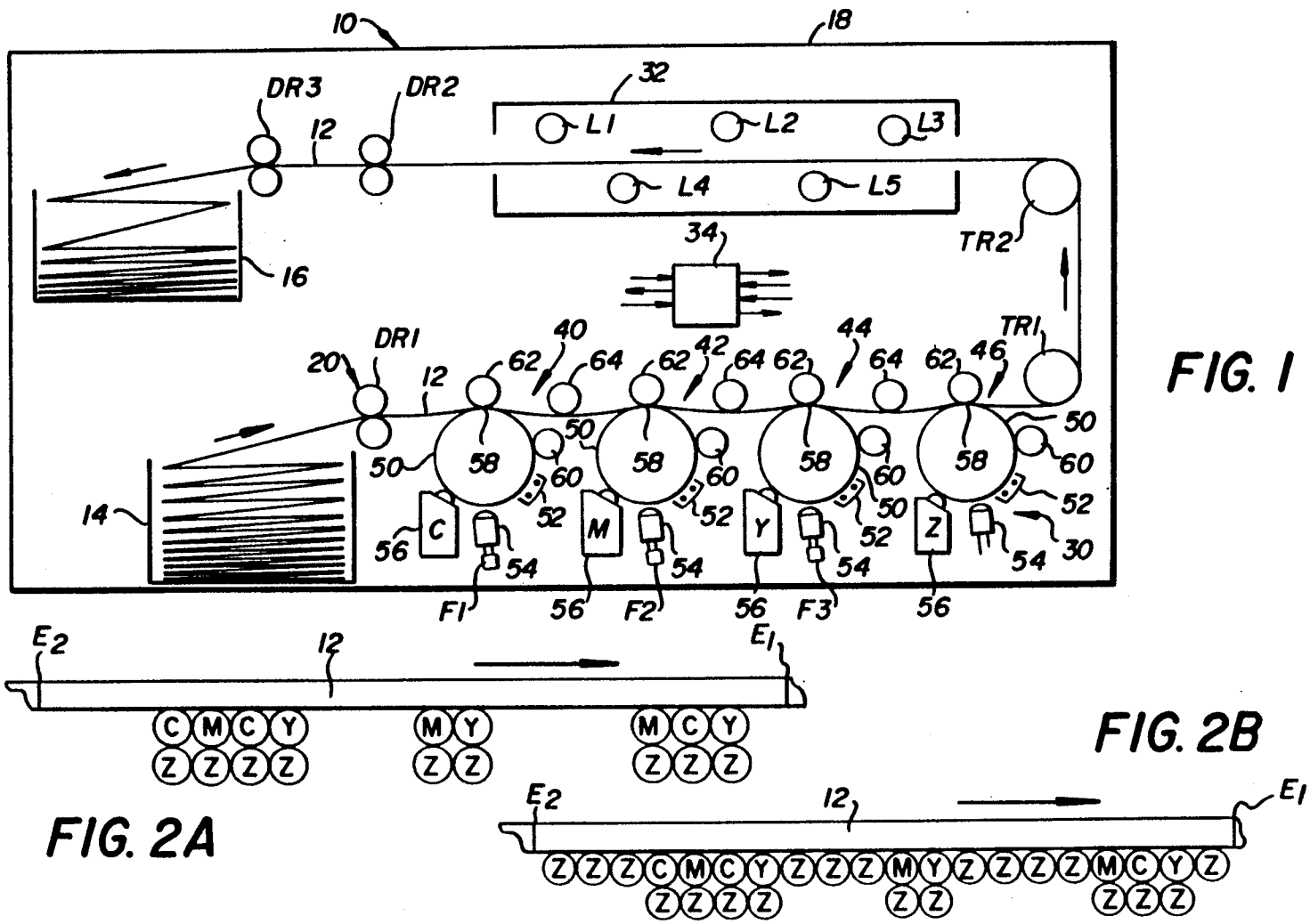
FIG. 1 is a schematic illustration of an electrostatographic color image reproduction apparatus for practicing the present invention.
FIG. 2A is a side section of the image-bearing member of FIG. 1 showing a raised multiple color toner image following final development according to the present invention.
FIG. 2B is the image of FIG. 2A including background area development for uniform glossing.

Referring now to the drawings, FIG. 1 illustrates an electrostatographic reproduction apparatus generally designated 10. The apparatus 10 is suitable for electrostatographically making reproductions of an original image on a suitable receiver sheet or substrate 12, shown for example in the form of fan-folded sheets being fed from a supply source 14 thereof through to an output tray 16. The substrate or receiver sheets 12 can also be cut sheets, as is well known.

The apparatus 10 further includes a housing 18, and means generally designated 20 for handling the receiver sheets 12. The means 20, as shown, may include a number of nip-forming drive rollers, for examples, DR1, DR2 and DR3, as well as, a series of training rollers including TR1, and TR2. The apparatus 10 also includes means designated generally as 30, for forming, developing, and transferring images to the substrate 12. The means 30 is shown, for example, as a plurality of electrostatographic assemblies each being useful for making and transferring unfused toner images or reproductions of an original multiple color image to the substrate 12. The transferred unfused image, as shown, can thereafter be fused onto the substrate 12 by means of a fusing apparatus 32 that includes heat lamps L1–L5. As is well known, in the apparatus 10, the operations of its various components, as well as, its various functions, can be controlled by means of a logic and control unit (LCU) shown as 34.

Still referring to FIG. 1, the plurality of electrostatographic assemblies, that is, the means 30, consists of a first assembly 40, intermediate assemblies, for example, 42–44, and a final or last assembly 46. The number of intermediate assemblies depends on the number of different colors in the multiple color image being produced. Each assembly 40–46, as shown, includes an image-bearing member 50, shown as a photoconductive drum. Member 50, of course, can also be an endless photoconductive web trained about a plurality of rollers. Suitable means (not shown) under the control of the LCU 34 are provided for driving each image-bearing member 50 in the clockwise direction as shown, for example.

As further shown, each assembly 40–46 also includes other well known electrostatographic process stations located about the periphery of its respective image-bearing member 50, in operative relation therewith. These process stations include a charging station 52, an imagewise exposure or imaging station 54, a toner particle development station 56, an image transfer station 58, and a cleaning station 60.

According to the present invention, the imagewise exposure or imaging station 54 of the first, and of all intermediate assemblies, for example, 40–44, additionally each includes means for producing a color separation of a multiple color original image that is being produced or reproduced. For example, such color separation image producing means may each include a color filter $F_1$, $F_2$ and $F_3$, respectively. As is also well known, such color separation images can also be produced electronically by means of a laser or an LED array connected to appropriate means for supplying the electronic signals for each such color separation image.

In the present invention, a particular and different color separation image, of the multiple color original, is formed at each such assembly 40–44. Referring now to the first assembly 40, and to FIG. 2A, according to the method of the present invention, a latent image of the first color separation of the original is formed electrostatically on the photoconductive member 50 as is well known, using the charging station 52, and the exposure station 54. The latent image so formed is then developed or toned at the development station 56 of the assembly 40 using charged toner particles of a first color, for example, cyan, shown as C (FIG. 2). The resulting first color separation toner image is thereafter transferred at the transfer station 58 thereof to a portion, for example, $E_1$-$E_2$ (FIG. 2) of the receiver sheet or substrate 12. In order to effect such transfer, the portion $E_1$-$E_2$ of the substrate 12 is fed by the means 20, in registration, to the transfer station 58. As shown, the transfer station 58 may include a backup roller 62 for forming an image transfer nip with the image-bearing member 50.

Referring now to the intermediate assemblies 42–44 of FIG. 1, and to FIG. 2A, additional and different color separation toner images of the same original, according to the method of the present invention, will be similarly formed, and developed for example in magenta shown as M, and in yellow shown as Y at each different assembly. Similarly, each such color separation toner image is then also transferred successively, and in registration, at each such assembly to the same portion $E_1$-$E_2$ of the substrate 12 as it is successively being advanced from one such intermediate assembly to the other. Idler rollers shown as 64 may be located between the assemblies 40–46 for assisting the feeding and registration of the the portions $E_1$-$E_2$ at each transfer station.

By the time the portion $E_1$-$E_2$ of the substrate 12 reaches the transfer station 58 of the final or last assembly 46, such portion $E_1$-$E_2$ will have thereon the composite or combined patterns of the toner markings of the first, and of the intermediate color separation images shown as, for example, C, M and Y, (FIG. 2A). This composite or combination toner pattern, of course, represents the full and complete multiple colors of the multiple color original image being produced or reproduced.

The number of such markings C, M, Y, as well as, the number of image-producing assemblies 40–46 in the set of first and intermediate assemblies depend on the number of colors in the multiple color original being produced or reproduced. A four-color original, for example, will require four assemblies in the set of first and intermediate assemblies 40–44. In such an example, four different color toner markings will therefore be on the portion $E_1$-$E_2$ of the substrate 12, by the time such portion reaches the final assembly 46.

Referring now to the final or last electrostatographic assembly 46 of FIG. 1, and to FIG. 2A, the assembly 46 is the same processwise as the others, except that according to the present invention, its exposure station 54 does not include means for forming a color separation image. The assembly 46, for example, does not include a color filter, and therefore cannot, and does not, produce color separation images. The latent image it forms electrostatically instead will therefore be an image of the full and composite original image, and not merely a color separation image thereof. As such, the full image so formed at this final assembly 46 will have the same pattern and dimensions as the composite or combination image of all the upstream color separation images already on the portion $E_1$-$E_2$ of the substrate 12.

In addition, according to the present invention, the development station 56 of the final assembly 46 is also different in that it includes a colorless toner shown as Z. Consequently, the full latent image so formed as above will be developed at the development station 56 of the assembly 46 with such colorless toner Z. The full colorless toner image is then transferred in registration at the transfer station 58 of the assembly 46 onto the portion $E_1$-$E_2$ of the substrate 12, and therefore directly on top of the composite or combination multiple color image pattern, for example the CMY pattern, already on such portion $E_1$-$E_2$.

The result of such transfer of the colorless toner pattern is a raised unfused multiple color toner image on the portion $E_1$-$E_2$ as shown, for example, in FIG. 2A. In effect, the raised image is achieved as such, by overlaying, or raising the toner patterns (CMY) already on the portion $E_1$-$E_2$, with the pattern of the colorless toner Z. Advantageously, such a raised multiple color image can be produced efficiently and acceptably in one pass of the substrate 12 through the apparatus 10, and on a substrate 12 of any desired color, since the overlay toner Z is colorless.

Thereafter, the portion $E_1$-$E_2$ of the substrate 12 with such a raised multiple color toner image thereon can be moved, as shown by the arrows, through the fusing station 32 for fusing. Following such fusing, the substrate 12, for example, the sheet copies as shown can then be collected in a fan-folded manner within the output tray 16, or torn off, a sheet portion at a time, as the need may be.

Referring again to the final assembly 46, and to FIG. 2B, according to the present invention, the final assembly 46 may alternatively be operated without an imagewise exposure station 54 thereof. Accordingly, its charged photoconductive image-bearing member 50 will not be imagewise exposed. In other words, the surface of the member 50 will be charged at the charging station 52, and an entire imaging portion of such surface, corresponding to the portion $E_1$-$E_2$ of the substrate 12, will then be moved unaltered to the development station 56 thereof where the entire area is developed with the colorless toner Z. Thereafter, the colorless toner pattern on the surface area of the member 50 is transferred in registration at its transfer station 58 onto the entire $E_1$-$E_2$ portion of the substrate 12. Such entire transfer, as shown, puts the colorless toner Z on image and non-image areas of the portion $E_1$-$E_2$.

One result of such transfer, as shown in FIG. 2B, will be raised multiple color toner production or reproduction, on the portion $E_1$-$E_2$, of the multiple color original image. Another result, however, will be a blanketing of the non-image areas of the portion $E_1$-$E_2$ with the colorless toner Z. The overall effect is a desirably high, and uniform glossing of the finished copy after fusing, of both the image, as well as the non-image areas of the portion $E_1$-$E_2$.

As can be seen, the present invention provides an electrostatographic method and apparatus for producing raised images, and particularly for producing raised multiple color reproductions of an original image on a suitable substrate of any desired color. Because the toner or marking particles according to the method of the present invention are dry powders, the method does not suffer from the disadvantages, for example, of a wet ink lithographic process. Additionally, the use of a colorless final electrostatographic assembly according to the method of the present invention, advantageously allows for the production of high-quality glossy copies.

The invention has been described in detail with particular reference to presently preferred embodiments, but it will be understood that variations and modifications can be effected within the spirit and scope of the invention.

I claim:

1. A method for producing a raised multiple color image on a substrate, the method comprising the steps of:

(a) forming a first latent image electrostatically on an image-bearing member;

(b) forming a second latent image electrostatically on an image-bearing member;

(c) toning said first and second latent images with toner particles of a first color and of a second color, respectively;

(d) forming a third latent image electrostatically on an image-bearing member, such that said third latent image is a combination of said first and second latent images;

(e) toning said third latent image with colorless toner particles; and (f) transferring said first, second, and third toner particle toned images, in registration, onto the substrate such that said third image is directly on top of said first and second images.

2. The method of claim 1 wherein a plurality of said second images are so formed, toned and transferred.

3. The method of claim 1, including the step of fusing said first, second and third toner images onto the substrate.

4. A method for electrostatographically producing raised multiple color toner reproductions of a multiple color original image on a suitable receiver sheet, the method comprising the steps of:

(a) electrostatographically producing a first color separation toner image of the original using a first image-bearing member;

(b) transferring said first color separation toner image to a moving portion of the receiver sheet;

(c) electrostatographically producing another and different color separation toner image of such original using another image-bearing member;

(d) transferring said another color separation toner image in registration onto said moving portion of the receiver sheet;

(e) electrostatographically producing a colorless toner full image of such original using a last image-bearing member; and (f) transferring said colorless toner full image in registration onto said moving portion of the receiver sheet, directly on top of said first and second images thereby forming a raised multiple color toner image on said portion.

* * * * *